United States Patent [19]

Jacobs, Jr.

[11] 4,205,294

[45] May 27, 1980

[54] SOLDERLESS FUSE TERMINAL

[75] Inventor: Philip C. Jacobs, Jr., Newtonville, Mass.

[73] Assignee: Gould Inc., Rolling Meadows, Ill.

[21] Appl. No.: 945,542

[22] Filed: Sep. 25, 1978

[51] Int. Cl.[2] ..... H01H 85/16

[52] U.S. Cl. ..... 337/234; 335/248; 335/252

[58] Field of Search ..... 337/234, 236, 186, 246, 337/248, 252, 231

[56] References Cited

U.S. PATENT DOCUMENTS

| | | | |
|---|---|---|---|
| 3,153,713 | 10/1964 | Brandt, Jr. | 337/234 |
| 3,979,709 | 9/1976 | Healey, Jr. | 337/186 |

FOREIGN PATENT DOCUMENTS

| | | | |
|---|---|---|---|
| 689050 | 6/1964 | Canada | 337/236 |

*Primary Examiner*—Harold Broome
*Attorney, Agent, or Firm*—Erwin Salzer

[57] ABSTRACT

The invention is predicated on the use of synthetic resins as materials for fuse casings or fuse tubes because synthetic resins are relatively easily deformable. This invention is particularly applicable in connection with fuse tubes made of polyester resin and glass fibers. Such tubes lend themselves to making solderless fuse terminals, i.e. electrically conductive joints between the ferrules, or fuse caps, and the fusible element, or elements, inside the fuse tube. The fusible element is located inside the casing or fuse tube and bent over the rim thereof, and has a portion that engages the outer surface of the casing. A ferrule is mounted on the casing and has an indentation in registry with the portion of the fusible element on the outer surface of the aforementioned casing, said indentation engaging and deforming said portion of the fusible element on the outer surface of said casing and exerting a pressure against the aforementioned portion of the fusible element sufficient to establish a conductive, solderless pressure connection between the aforementioned portion of said fusible element and the said ferrule. A portion of the ferrule, or fuse cap, provides a backup for the solderless joint.

7 Claims, 4 Drawing Figures

SOLDERLESS FUSE TERMINAL

BACKGROUND OF THE INVENTION

U.S. Pat. No. 3,979,709 to Daniel P. Healey, Jr.; Sept. 7, 1976 for ELECTRIC FUSE HAVING A MULTIPLY CASING OF A SYNTHETIC-RESIN-GLASS-CLOTH LAMINATE describes a novel fuse tube that has characteristics different from conventional fuse tube materials such as, for instance, ceramic fuse casing, or fuse casings of glass. The casings according to the above referred-to patent, particularly if made with a binder of synthetic polyester resin, are relatively soft and relatively easily deformable in comparison to the prior art casings listed above. This is the starting point of the present invention on which the latter is predicated.

While this invention is not limited to fuse casings as described in the above patent, but may be used, for instance, in connection with casings of convolutely wound melamine impregnated glass cloth and other laminates of synthetic resin, best results are obtained with casings manufactured in accordance with U.S. Pat. No. 3,979,709 and impregnated with polyester resins.

SUMMARY OF THE INVENTION

According to this invention a fusible element is placed inside of a tubular fuse casing easily deformable, for instance, a casing as described in U.S. Pat. No. 3,979,709 impregnated with polyester resin. The fusible element is bent over one of the rims of the casing, and has a portion engaging the outer surface of the casing. A ferrule mounted on said casing has a radially inward directed indentation in registry with said portion of said fusible element on the outer surface of said casing, said indentation engaging and deforming said portion of said fusible element on the outer surface of said casing and exerting sufficient pressure against said portion of said fusible element to establish an electrically connective solderless joint between said portion of said fusible element and said ferrule. The indentation in the ferrule and the portion of the fusible element in registry with it and with the casing at this particular point are backed-up by a portion of the ferrule inside the casing of the fuse.

DESCRIPTION OF PREFERRED EMBODIMENTS

Figure 1:
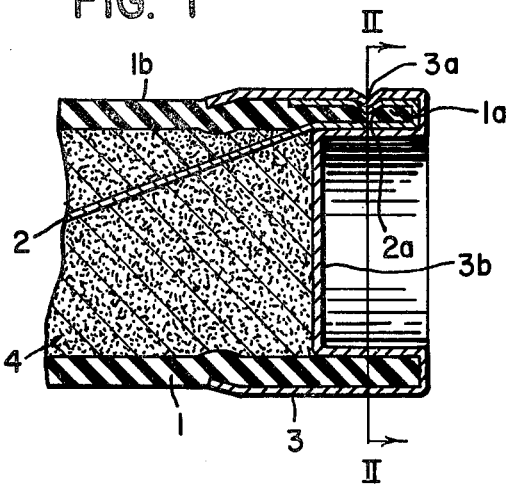
FIG. 1 shows in longitudinal section a first embodiment of the invention.
Figure 2:
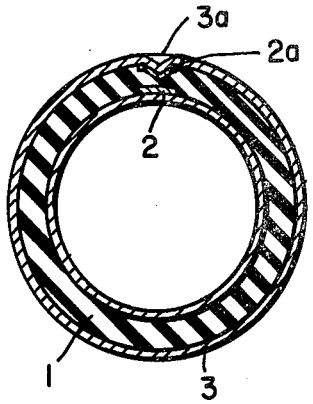
FIG. 2 is a transverse section along II—II of FIG. 1.

Referring now to the drawings, and more particularly to FIGS. 1 and 2 thereof, numeral 1 has been applied to indicate a tubular casing of a relatively easily deformable electric insulating material combining glass-fiber layers, or plies, e.g. with polyester, as described in the above referred-to U.S. Pat. No. 3,979,709. The tubing may be produced by the so-called pultrusion process described in detail in U.S. Pat. No. 3,979,709. FIGS. 1 and 2 show but one end of an electric fuse. The other end is identical with the end shown in FIGS. 1 and 2, and also in FIGS. 3-4. The fusible element 2 inside of casing 1 is of silver or copper and bent over rim 1*a* thereof, and has a portion 2*a* engaging the outer surface 1*b* of casing 1. Mounted on casing 1 under pressure is a ferrule 3. Ferrule 3 has a radially inward indentation 3*a* in registry with said portion 2*a* of fusible element 2 on the outer surface of casing 1. Said indentation 3*a* engages and deforms the portion 2*a* of fusible element 2 on the outer surface 1*b* of casing 1, and exerts such a pressure against said portion 2*a* of said fusible element 2 to establish an electrically conductive pressure joint between said portion 2*a* of said fusible element 2 and said ferrule 3. The indentation 3*a* in ferrule 3 may be effected by means of a prick punch, or like instrument. The pressure used to jointly deform ferrule 3 at 3*a* and fusible element 2 at 2*a* tends to produce a bulge at the inside of casing 1 juxtaposed to joints 2*a* and 3*a* where a pressure-joint is established between portion 2*a* of fusible element 2 and groove 3*a* of ferrule 3. To avoid such internal bulge inside of casing 1 to occur the portion of ferrule 3 engaging the inner wall of casing 1 provides a back-up for the solderless conductive pressure connection between parts 2*a* and 3*a*.

Referring now to the structure in FIGS. 3 and 4, casing 1 is made of a material of the kind shown in, and described in connection with, FIGS. 1 and 2, i.e. relatively deformable material such as produced by the pultrusion process disclosed in U.S. Pat. No. 3,979,709. Casing 1 is circular in cross-section, having a rim 1*a* and housing fusible element 2 on its inside. Fusible element 2 is bent over rim 1*a* and engages the outer surface of casing 1. Reference character 1*b* has been applied to indicate the outer surface of casing 1 engaged by the surface of ferrule 3. The surface of ferrule 3 has a radially inwardly projecting circularly shaped indentation 3*a* engaging and deforming said fusible element and establishing a solderless conductive pressure-joint between the portion 2*a* of said fusible element 2 engaging the outer surface 1*b* of said casing 1 and said annular indentation 3*a* of said ferrule 3. In order to apply two-sided clamping pressure, i.e. to avoid radially inward movement of the point where the portion 2*a* of fusible element 2 and annular groove 3*a* overlap, ferrule 3 has a portion 3*b* engaging the inside of casing 1 and backing-up the internal wall thereof juxtaposed to said circularly shaped indentation 3*a*. That back-up portion 3*b* may be in the same plane as indentation 3*a* (FIG. 3), or project beyond that plane (FIG. 1).

Regarding the material of which fuse tube 1 is made, it comprises preferably a radially outermost ply and a radially innermost ply of woven glass fibers and at least an intermediate ply of matte material having random oriented fibers, as disclosed in considerable detail in U.S. Pat. No. 3,979,709.

Figure 3:
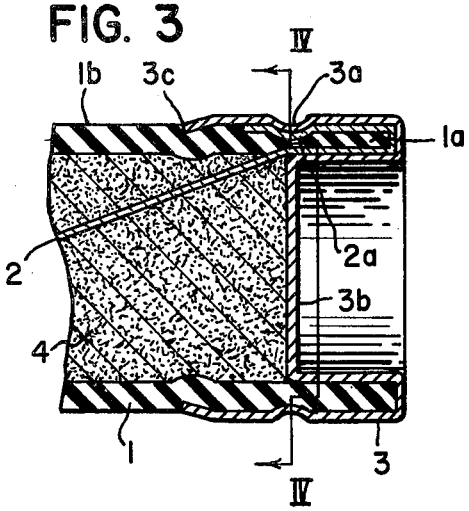
FIG. 3 shows in longitudinal section a second embodiment of the invention.
Figure 4:
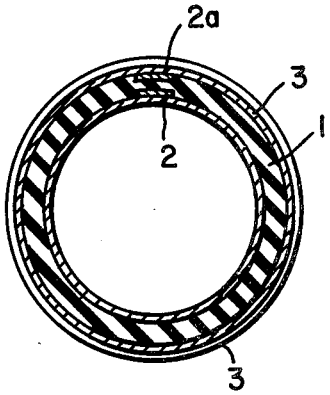
FIG. 4 is a transverse section along IV—IV of FIG. 3.

FIGS. 3 and 4 show the preferred embodiment of the invention. It will be understood that the circular groove formed in casing 1 for receiving the portion 2*a* of fuse link 2 is merely produced by the pressure of annular groove or annular indentation 3*a*, or the pressure of a machine producing annular groove or indentation 3*a*, but is not machined by a process removing material from casing 1. The axially outer surface of ferrule 3 extends beyond the axially annular indentation 3*a* and is crimped into soft casing 1 at 3*c* in the absence of any pre-machined edge-receiving groove therein.

The fuse casing may or may not be filled with a pulverulent arc-quenching filler 4. Where the engaging surfaces 2*a*, 3*a* are not of silver, e.g. of copper, silver plating is indicated for good current transfer, e.g. fusible elements should always be silver plated at points 2*a*.

I claim as my invention:

1. In an electric fuse the combination of (a) a tubular deformable casing including a synthetic resin, said casing having a rim;

(b) a fusible element inside said casing bent over said rim and having a portion engaging the outer surface of said casing;

(c) a ferrule mounted on said casing and having a radially inwardly directed indentation in registry with said portion of said fusible element on the outer surface of said casing, said indentation engaging and deforming said portion of said fusible element on the outer surface of said casing and exerting such a pressure against said portion of said fusible element as to establish an electrically conductive solderless pressure-joint between said portion of said fusible element and said ferrule; and (d) said ferrule having a portion engaging the inner wall of said casing and providing a back-up for said conductive solderless pressure joint.

2. In an electric fuse as specified in claim 1 wherein said casing comprises polyester resin and glass fibers.

3. In an electric fuse the combination of (a) a deformable tubular casing of fiber re-inforced synthetic resin;

(b) said casing being circular in cross-section, having a rim and housing a fusible element on the inside thereof, said fusible element being bent over said rim and engaging the outer surface of said casing;

(c) a ferrule with an outer surface engaging the outer surface of said casing, said outer surface of said ferrule having a radially inwardly projecting annular indentation engaging and deforming said fusible element and establishing a solderless conductive pressure joint between the portion of said fusible element engaging the outer surface of said casing and said annular indentation of said ferrule; and (d) said ferrule having a portion engaging the inside of said casing and backing-up the internal wall thereof juxtaposed to said annular indentation and precluding the inner wall of said casing from bulging radially inwardly.

4. In an electric fuse as specified in claim 3 wherein said tubular casing comprises a radially outermost ply and a radially innermost ply of woven fibers and at least an intermediate ply of matte material having random oriented fibers.

5. In an electric fuse as specified in claim 3 wherein said outer surface of said ferrule extends axially beyond said annular indentation and forms an annular edge crimped into said casing in the absence of any premachined edge-receiving groove.

6. In an electric fuse including (a) a tubular casing of fiber re-inforced synthetic resin;

(b) said casing being circular in cross-section, having a rim and housing a fusible element on the inside thereof, said fusible element being bent over said rim and engaging the outer surface of said casing;

(c) a ferrule having an outer surface with a lateral annular indentation intersecting said portion of said fusible element under sufficient pressure to deform said portion of said fusible element and to establish a conductive connection between said portion of said fusible element and said annular indentation to form a conductive connection between these parts in the absence of any solder; and (d) said ferrule having a portion substantially equal to the diameter of said casing, projecting axially inwardly into said casing beyond the area juxtaposed to said annular indentation.

7. In an electric fuse as specified in claim 6 wherein said ferrule has a portion substantially equal to the diameter of said casing, projecting axially inwardly into said casing beyond the area juxtaposed to said annular indentation.

* * * * *